United States Patent [19]

Shimura et al.

[11] Patent Number: 4,650,231

[45] Date of Patent: Mar. 17, 1987

[54] STRIKER FOR A LOCKING DEVICE

[75] Inventors: Ryoji Shimura, Yokohama; Yuichi Kato, Tokyo, both of Japan

[73] Assignee: Ohi Seisakusho Co., Ltd., Yokohama, Japan

[21] Appl. No.: 822,056

[22] Filed: Jan. 24, 1986

[30] Foreign Application Priority Data

Jan. 25, 1985 [JP] Japan ..... 60-11096

[51] Int. Cl.[4] ..... E05B 15/02

[52] U.S. Cl. ..... 292/340; 411/368; 411/546

[58] Field of Search ..... 292/216, 340, 346; 411/368-370, 545, 546, 531, 533, 537

[56] References Cited

U.S. PATENT DOCUMENTS

| | | | |
|---|---|---|---|
| 1,641,059 | 8/1927 | Tausch | 411/155 |
| 2,723,151 | 11/1955 | Seyforth | 292/340 |
| 2,867,874 | 1/1959 | Larson | 411/531 X |
| 4,112,693 | 9/1978 | Collin et al. | 411/531 X |
| 4,371,293 | 2/1983 | Wilcox et al. | 411/531 X |
| 4,445,808 | 5/1984 | Arya | 411/531 X |
| 4,466,645 | 8/1984 | Kobayashi | 292/216 X |

FOREIGN PATENT DOCUMENTS

| | | | |
|---|---|---|---|
| 397570 | 2/1966 | Switzerland | 411/54 |
| 2071250 | 9/1981 | United Kingdom | 411/368 |

*Primary Examiner*—Robert L. Wolfe
*Assistant Examiner*—Russell W. Illich
*Attorney, Agent, or Firm*—Zarley, McKee, Thomte, Voorhees & Sease

[57] ABSTRACT

A striker for a locking device which is mounted either a main body or an opening and closing member such as a door or hood in an automobile by tightening bolts passing through bores of the mounting portions in a base plate and is adapted for engagement with a latch to restrict movements of the member. A thin steel or other metal plate is used to form the base plate lighten weight of the striker, and outer periphery of the bore is formed to rise at an angle within 90 to receive tightening force exerted through bearing surface of the bolt as compressive load without causing deformation of the mounting portion.

7 Claims, 11 Drawing Figures

STRIKER FOR A LOCKING DEVICE

BACKGROUND OF THE INVENTION

1. Field of the Invention

The present invention relates to a striker for a door locking device for automobiles or any other locking device for opening and closing members mounted to be opened and closed freely relative to a main body, in which said striker is mounted to either one of the main body such as a vehicle body and the member such as a door or a hood, and also is adapted to engage with a latch mounted to the other one of them so as to restrict movements of the opening and closing member.

2. Description of the Prior Art

The above mentioned strikers have been well known and widely used in door locking devices for automobiles and one example of such strikers is shown in FIGS. 6 and 7.

This striker is constructed such that an upwardly expanded portion 22 is formed long in the forward and backward direction at the center of a base plate 21 made of steel having a large thickness d1, an engaging bar member 23 formed into U-shape opening downward by bending a steel bar material is installed by crimping both ends thereof at the front and rear parts of the expanded portion 22, countersunk-head bolts 25 are passed through countersinks 24 bored in the upper face of both sides of the base plate 21, and by means of the countersunk-head bolts 25 the base plate 21 can be fixedly attached to a vehicle body or a door.

However, in this construction, a steel plate of large thickness d1 must be used so that there are disadvantages that manufacturing is difficult and the entire device becomes heavy.

Now, there has been proposed a striker, as shown in FIGS. 8 and 9, which is made from a steel plate of thin thickness d2 by press working in such that a base plate 34 is formed to have an upwardly expanded portion 32 in the central part of the plate except the peripheral part 31 thereof and to have countersinks 33 with edges **33*a* bent downward in cone-shape at both sides of the expanded portion 32, and an engaging bar member 35 in U-shape opening downward is installed on the base plate 34 by crimping both ends of the bar member thereto at the front and rear parts in the center of the expanded portion 32** (for example, see Japanese Utility Model Publication No. 58-23887).

The above mentioned conventional thin type of striker has, on the one hand, an advantage that it can lighten weight of the device while maintaining a certain strength in comparison with a thick type, but on the other hand, has the following disadvantages. (1) When a great force F is exerted on the engaging bar member 35 to pull it upward after countersunk-head bolts 36 have been inserted through the countersinks 33 and the base plate 34 has been attached to a vehicle body or a door by the bolts 36, as shown in FIG. 10, the edges **33*a* of the countersinks 33 are deformed downward and at the same time the countersinks 33 are spread out to be enlarged of diameters thereof, so that it becomes easy to disengage heads 36*a* of the bolts 36 out of the countersinks 33 and strength against pulling apart after attachment of the device is weak. (2) If amounts of tightening the left and right countersunk-head bolts 36, 36 are different, for example the left bolt 36 is tightened more than the right bolt 36, the central part of the expanded portion 32 provided with the engaging bar member 35 may be inclined, and with this inclination, the engaging bar member 35 might be also inclined leftward as indicated by an arrow 37 in FIG. 9 to make angle of mounting the engaging bar member 35 (this angle is usually set at 90 relative to the base plate 34**) out of order and to bring bad engagement with a latch (not shown).

The present invention has an object to provide a striker for a locking device which can solve all the drawbacks as mentioned above, is light weight and has a great strength against pulling apart.

SUMMARY OF THE INVENTION

A striker for a locking device according to the invention is characterized by that a base plate provided with an engaging bar member for engaging with a latch to stand thereon includes mounting portions which have outer peripheries raised upwardly at least at an angle within 90 and also have bores at the center thereof for bolts passing through said bores.

According to the invention, the outer periphery of each mounting portion having a bore at the center thereof is raised upward from a bottom plate portion of the base plate being inclined at an angle within 90, so that when bolts are passed through said bores and the base plate is installed onto the main body or opening and closing member with these bolts, end faces of the peripheries of the mounting portions abut with lower bearing faces of heads of the bolts, forces of tightening the bolts work on the peripheries as compressive loads, and very little bending load will work on the peripheries.

Therefore, there will be little possibility that the outer peripheries of the mounting portions are deformed even when the bolts are strongly tightened. And after the attachment of the bolts, even if a strong force is exerted on the engaging bar member to pull it apart upward, only compressive loads may work on the outer peripheries of the mounting portions without causing easy deformation of the peripheries, and further, even if the outer peripheries were squashed by high compressive loads exerted thereon, diameters of the bores would not be enlarged to surely prevent the heads of the bolts from coming out of the bores, so that a striker having a greater strength against pulling apart than the prior art can be obtained.

Further, during installation by tightening the bolts, a component of the tightening force exerted on the outer peripheries of the mounting portions as compressive loads works on the bottom plate portion to let the portion tightly fit with mounting surface of the main body or opening and closing member, so that there is no danger that a part of the bottom plate member will partially rise, or difference in amounts of tightening the left and right bolts will cause the angle of mounting the engaging bar member out of order as described with reference to the conventional striker as mentioned above.

BRIEF DESCRIPTION OF THE DRAWINGS

The invention will now be described by way of example, with reference to the drawings, in which.

DESCRIPTION OF THE PREFERRED EMBODIMENT

Figure 1:
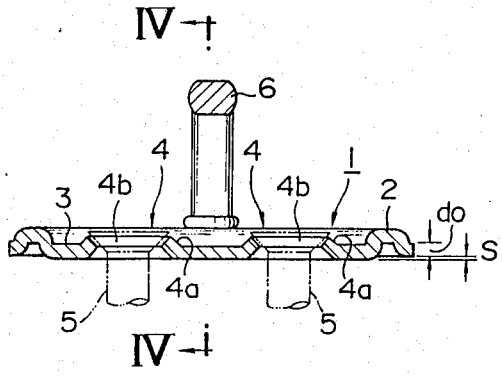
FIG. 1 is a central longitudinal sectional view in elevation of one embodiment of the present invention.
Figure 2:
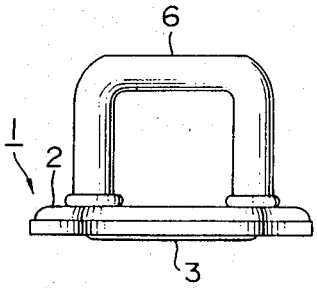
FIG. 2 is a side view.
Figure 3:
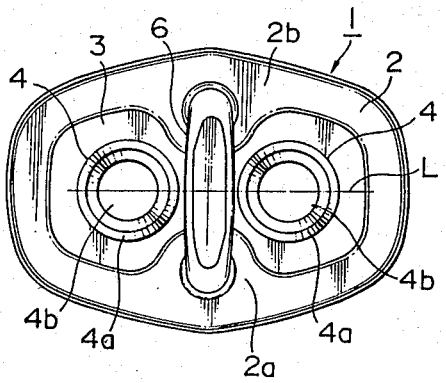
FIG. 3 is a plan view.
Figure 4:
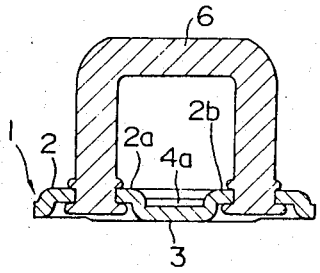
FIG. 4 is a longitudinal sectional view in side elevation along a line IV—IV in FIG. 1.

Now, explanations will be made on one embodiment of the present invention with reference to FIGS. 1 to 5.

The numeral 1 denotes a base plate formed from a steel plate or the other metal plate of thin thickness d0 by press working, which contour is nearly elliptic in a plane and almost flat as a whole.

This base plate 1 is formed at the periphery thereof with a continuous upwardly expanded portion 2 which is low and has an U-shaped cross section opening downward, and this expanded portion 2 includes at the front and rear center thereof wide portions 2*a*, 2*b* extending in semicircular inward toward each other.

Inside the expanded portion 2 is formed a flat bottom plate portion 3 which is lower than the top level of the expanded portion 2.

On both left and right sides of the bottom plate portion 3 are formed mounting portions 4 each rising upward in truncated cone shape at the outerperiphery 4*a* thereof and having a countersink 4*b* at the center thereof for tightening countersunk-head bolt 5.

Here, height of the top of the outer periphery 4*a* is determined to be slightly lower than height of the top of the expanded portion 2, and the lower face of outer edge of the expanded portion 2 is determined to be higher than the lower face of the bottom plate portion 3 by a small distance S.

At each center of the wide portions 2*a*, 2*b* at the front and rear of the expanded portion 2 lying between both mounting portions 4, 4 in the base plate 1, an engaging bar member 6 formed into U-shape opening downward in a side view by bending a steel bar material is installed on the base plate 1 with each end thereof passing through the plate and is hot-staked at the upper and lower parts of portions of both ends passing through the plate.

Thus, the engaging bar member 6 is mounted to be perpendicular to a straight line L connecting the centers of both mounting portions 4, 4 in a plan view and to stand upright from the central part of the base plate 1 in a front view.

This striker is fixedly attached to either one of a main body such as an automobile body and an opening and closing member such as a door by means of the countersunk-head bolts 5 being inserted through the countersinks 4*b*, 4*b* of the mounting portions 4, 4 of the base plate 1, and in use, is adapted to restrict movements of the opening and closing member by making an engagement of the engaging barmember 6 with a latch (not shown) mounted onto the other one of them.

Figure 5:
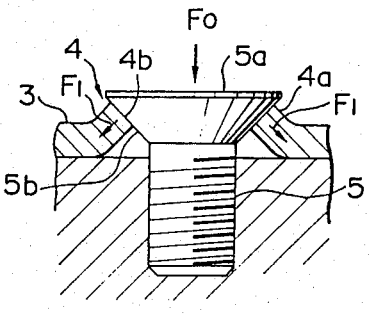
FIG. 5 is an enlarged longitudinal sectional view of a principle for explaining functions.

As this embodiment of a striker is constructed such as the above, when the countersunk-head bolts 5 are inserted through the countersinks 4*b* and by these bolts 5 the base plate 1 is attached to the main body or the opening and closing member, as shown in FIG. 5, end faces of the outer peripheries 4*a* of the mounting portions 4 abut on the tapered surfaces 5*b* of the head 5*a* of the countersunk-head bolt 5 at a substantially right angle, a component F1 of tightening force F0 of the countersunk-head bolt 5 works on the outer peripheries 4*a* only as compressive load, and very little bending load will work on the peripheries 4*a*.

Therefore, there is little danger that the outer peripheries 4*a* of the mounting portions 4 are deformed even if the countersunk-head bolts 5 are strongly tightened. And after the attachment of the countersunk-head bolts 5, even if a strong force is exerted on the engaging bar member 6 to pull it apart upward, only compressive load may work on the outer peripheries 4*a* of the mounting portions 4 without causing easy deformation of the peripheries 4*a*, and further, even if the outer peripheries 4*a* were squashed by high compressive loads exerted thereon, diameters of the bores 4*b* would not be enlarged to surely prevent the heads of the bolts 5 from coming out of the bores, so that a striker having greater strength against pulling apart than the prior art can be obtained.

Figure 8:
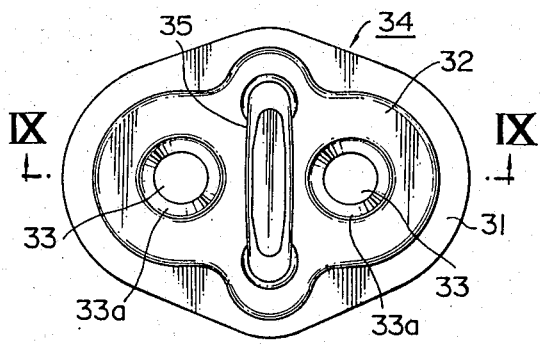
FIG.8 PRIOR ART
FIG. 8 is a plan view illustrating another example of a striker of the prior art.
Figure 9:
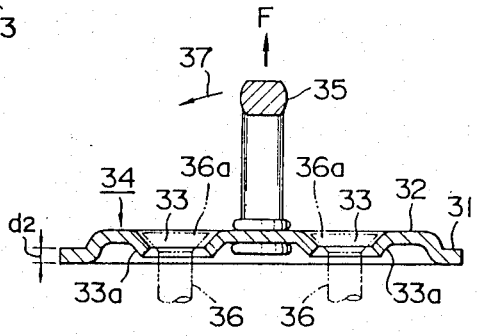
FIG.9 PRIOR ART
FIG. 9 is a longitudinal sectional view in elevation along a line IX—IX in FIG. 8.
Figure 10:
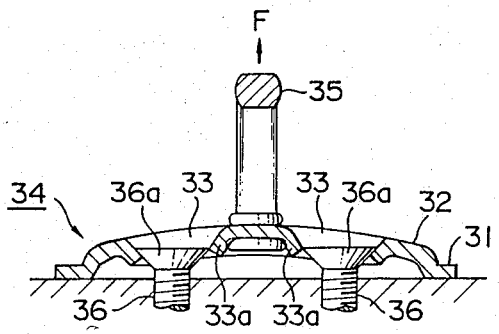
FIG.10 PRIOR ART
FIG. 10 is a longitudinal sectional view in elevation illustrating a state of the striker in FIG. 9 being taken off.

In an experiment, metal plates having equal thickness before press working were used, and all the conditions such as external dimensions of the base plates after press working and such as material, shape, dimension, quenching values of the engaging bar members were selected the same except configuration of the base plates in order to prepare two different two strikers, one having a base plate of the same configuration with this embodiment and another having a base plate of the same configuration as illustrated in FIGS. 8 and 9. The two strikers were fixed to supporting members (not shown) by the same countersunk-head bolts, and both engaging bar members were pulled upward on the same conditions, and it has been found from this pulling apart experiment that the striker having the same configuration with the embodiment could put up with the load up to 3600 kg while the other striker of the configuration shown in FIGS. 8 and 9 was taken off at the load of 2500 kg.

Moreover, during the countersunk-head bolts 5 being tightened, a component F1 of the tightening force F0 exerted on the outer peripheries 4*a* of the mounting portions 4 as compressive load may work on the bottom plate portion 3 to let the portion fit tightly with mounting surface of the main body or opening and closing member, so that there is no danger that a part of the bottom plate portion 3 will partially rise, or difference in amounts of tightening the left and right bolts will cause the angle of mounting the engaging bar member 6 out of order as described with reference to the conventional striker as mentioned above.

Further, as the expanded portion 2 is provided around the periphery of the base plate 1, bending strength of the base plate 1 is so large that in cooperation with the above mentioned effects of the mounting portions 4 the strength can be improved and lightening of weight can be achieved, and as the expanded portion 2 surrounds the mounting portions 4, projection of the mounting portions 4 can be reduced in one's sight to improve the external appearance of the device.

Moreover, in the conventional striker as shown in FIG. 9, there is a danger that when a sidewise force is applied to the top of the engaging bar member 35 or when there is a difference in the amount of tightening between the left and right bolts, corners in the lower face of the peripheral edge 31 come into contact with the main body partly and coating with paints performed on that part of the main body is worn off, so that the main body is apt to rust from said part. In contrast, this embodiment has an advantage that there is no such danger as mentioned above because the lower face of the outer edge of the expanded portion 2 is slightly raised from the lower face of the bottom plate portion 3.

Figure 5A:
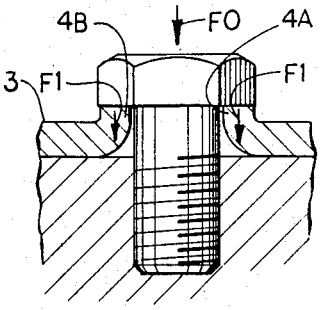
FIG. 5A is an enlarged longitudinal sectional view of an alternative bolt for attachment of the base plate.
Figure 6:
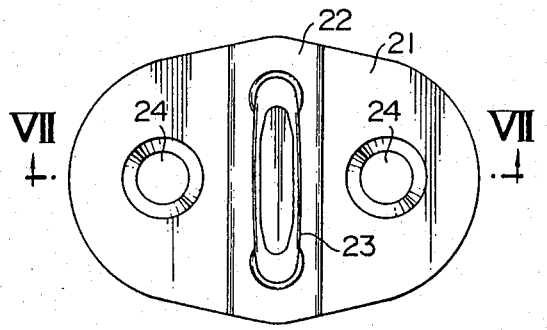
FIG.6 PRIOR ART
FIG. 6 is a plan view illustrating one example of a striker of the prior art.
Figure 7:
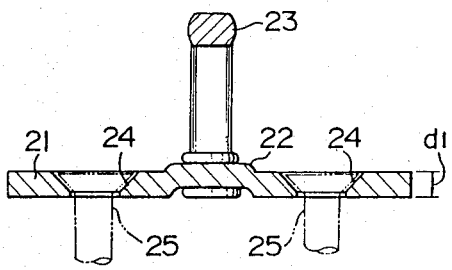
FIG.7 PRIOR ART
FIG. 7 is a longitudinal sectional view in elevation along a line VII—VII in FIG. 6.

Besides, the outer periphery 4*a* of the mounting portion 4 is not limited to the truncated cone shape but any other configuration so long as it is raised at an angle within 90 from the bottom plate portion 3 of the base plate 1, because the configuration of the outer periphery 4*a* is good enough so long as the outer periphery is constructed so as to receive the bolt as compressive load to prevent the bolt from taking off from the base plate 1. It is also possible to use a hexagonal-head bolt having a flat bearing surface, as shown in FIG. 5A, as a bolt for attachment of the base plate in addition to the countersunk-head bolt 5.

It will be clearly understood from the above that according to the present invention the base plate can be made thinner without reducing strength, particularly strength against pulling apart after the attachment, and the invention has an advantage of lightening the entire weight of the striker being achieved.

We claim:

1. A striker for a locking device which is mounted to either one of a main body and an opening and closing member mounted onto said main body to be opened and closed freely, and is adapted to engage with a latch mounted to the other one of them so as to restrict movements of the opening and closing member, characterized by that:

a base plate provided with an engaging bar member for engaging with said latch to stand thereon is provided with mounting portions having an outer periphery raised upward from a bottom portion of said base plate at least at an angle within 90° and also having a bore at the center thereof for a bolt passing through said bore, said bolt engaging said outer periphery such that said outer periphery is under a compressive load to prevent said bore from becoming enlarged.

2. A striker for a locking device as defined in claim 1, wherein the bolts passing through the bores of the mounting portions are countersunk-head bolts, the outer peripheries of the mounting portions are formed in truncated cone shape, and the bores formed at the center of the mounting portions are countersinks so as to receive bearing surfaces of said countersunk-head bolts.

3. A striker for a locking device as defined in claim 1, wherein the bolts passing through the bores of the mounting portions are hexagonal-head bolts, and end faces of the outer peripheries are formed to receive bearing surfaces of the hexagonal-head bolts when they are tightened.

4. A striker for a locking device as defined in claim 1 wherein said base plate has a peripheral edge and includes an upwardly expanded portion with a downwardly open U-shaped cross section extending around said peripheral edge.

5. The striker of claim 4 wherein the height of said outer periphery of said mounting portions is less than the height of said upwardly expanded portion.

6. The striker of claim 4 wherein said base plate further includes a bottom plate portion within said upwardly expanded portion and having a top surface residing in a plane lower than the plane of the top surface of said expanded portion.

7. The striker of claim 4 wherein said base plate further includes a bottom plate portion within said upwardly expanded portion, said expanded portion having a lower surface residing in a plane higher than the plane of the lower surface of said bottom plate portion.

* * * * *